US008371962B2

(12) United States Patent
Solheim et al.

(10) Patent No.: US 8,371,962 B2
(45) Date of Patent: Feb. 12, 2013

(54) METHODS APPARATUS, AND SYSTEMS TO CUSTOM FIT GOLF CLUBS

(75) Inventors: John K. Solheim, Anthem, AZ (US); Gregory J. Swartz, Anthem, AZ (US); Paul D. Wood, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 1123 days.

(21) Appl. No.: 12/051,501

(22) Filed: Mar. 19, 2008

(65) Prior Publication Data

US 2009/0088275 A1 Apr. 2, 2009

Related U.S. Application Data

(60) Provisional application No. 60/976,077, filed on Sep. 28, 2007.

(51) Int. Cl.
*A63B 57/00* (2006.01)

(52) U.S. Cl. ..... 473/407; 473/131; 473/409

(58) Field of Classification Search ..... 473/131–413; 700/91–93

See application file for complete search history.

(56) References Cited

U.S. PATENT DOCUMENTS

| | | | | |
|---|---|---|---|---|
| 4,059,270 | A | 11/1977 | Sayers | |
| 5,591,091 | A | 1/1997 | Hackman | |
| 5,846,139 | A * | 12/1998 | Bair et al. | 473/156 |
| 5,879,241 | A | 3/1999 | Cook et al. | |
| 5,911,636 | A * | 6/1999 | Schmoll | 473/266 |
| 5,951,410 | A | 9/1999 | Butler et al. | |
| 6,083,123 | A | 7/2000 | Wood | |
| 6,328,660 | B1 | 12/2001 | Bunn, III | |
| 6,379,258 | B1 | 4/2002 | To | |
| 6,431,990 | B1 | 8/2002 | Manwaring | |
| 6,565,449 | B2 * | 5/2003 | Buhler | 473/151 |
| 6,672,978 | B1 | 1/2004 | Morgan et al. | |
| 6,719,648 | B1 | 4/2004 | Smith | |
| 6,929,558 | B2 | 8/2005 | Manwaring et al. | |
| 6,966,843 | B2 | 11/2005 | Rankin et al. | |
| 7,041,014 | B2 | 5/2006 | Wright et al. | |
| 7,056,225 | B1 | 6/2006 | Pipkin | |
| 7,147,570 | B2 | 12/2006 | Toulon et al. | |
| 7,153,215 | B2 | 12/2006 | Peterson et al. | |
| 7,166,035 | B2 | 1/2007 | Voges et al. | |

(Continued)

FOREIGN PATENT DOCUMENTS

| | | |
|---|---|---|
| WO | 02/081039 A1 | 10/2002 |
| WO | WO2005/053798 | 6/2005 |

OTHER PUBLICATIONS

Gardiner Golf Simulator Systems—"Fusing Technology with the Art of Golf"—(May 23, 2006) http://web.archive.org/web/20060523042206/http://www.golf-simulators.com/physics.htm.*

(Continued)

*Primary Examiner* — Milap Shah
*Assistant Examiner* — George Howarah

(57) ABSTRACT

In one example, a method can comprise (i) receiving, at a processing device, physical characteristic information, performance characteristic information, and shot characteristic information associated with an individual, (ii) calculating, with a component option analyzer of the processing device, a first optimal component of a plurality of components for an optimized golf club for the individual based on at least one of the physical characteristic information, the performance characteristic information, or the shot characteristic information associated with the individual; and (iii) calculating, with the component option analyzer of the processing device, a second optimal component of the plurality of components based on the first optimal component. The processing device may calculate the first optimal option and the second optimal option via the component option analyzer. Other examples and related embodiments are disclosed herein.

67 Claims, 8 Drawing Sheets

U.S. PATENT DOCUMENTS

| | | | | |
|---|---|---|---|---|
| 7,273,427 | B2 | 9/2007 | Inoue et al. | |
| 7,967,695 | B2 * | 6/2011 | Voges et al. | 473/222 |
| 2002/0072429 | A1 * | 6/2002 | Rankin et al. | 473/287 |
| 2002/0155896 | A1 | 10/2002 | Gobush et al. | |
| 2003/0008731 | A1 | 1/2003 | Anderson et al. | |
| 2003/0040380 | A1 * | 2/2003 | Wright et al. | 473/409 |
| 2003/0191547 | A1 * | 10/2003 | Morse | 700/91 |
| 2004/0006442 | A1 | 1/2004 | Boehm | |
| 2004/0023725 | A1 | 2/2004 | Llewellyn et al. | |
| 2004/0127303 | A1 | 7/2004 | Teraoka | |
| 2004/0259653 | A1 | 12/2004 | Gobush et al. | |
| 2005/0070366 | A1 | 3/2005 | Manwaring et al. | |
| 2005/0085309 | A1 * | 4/2005 | McGann et al. | 473/151 |
| 2005/0159231 | A1 | 7/2005 | Gobush | |
| 2005/0181884 | A1 * | 8/2005 | Beach et al. | 473/131 |
| 2005/0215336 | A1 | 9/2005 | Ueda et al. | |
| 2005/0215340 | A1 | 9/2005 | Stites et al. | |
| 2005/0268704 | A1 | 12/2005 | Bissonnette et al. | |
| 2005/0272512 | A1 * | 12/2005 | Bissonnette et al. | 473/151 |
| 2005/0272516 | A1 * | 12/2005 | Gobush | 473/200 |
| 2005/0277483 | A1 | 12/2005 | Peterson et al. | |
| 2005/0282645 | A1 | 12/2005 | Bissonnette et al. | |
| 2006/0166757 | A1 | 7/2006 | Butler, Jr. et al. | |
| 2006/0211510 | A1 | 9/2006 | Ashida et al. | |
| 2007/0049393 | A1 * | 3/2007 | Gobush | 473/131 |
| 2007/0135225 | A1 | 6/2007 | Nieminen et al. | |
| 2007/0167247 | A1 | 7/2007 | Lindsay | |
| 2007/0167249 | A1 * | 7/2007 | Voges et al. | 473/222 |
| 2007/0298896 | A1 | 12/2007 | Nusbaum et al. | |
| 2008/0026869 | A1 * | 1/2008 | Galloway | 473/324 |
| 2008/0182685 | A1 | 7/2008 | Marty et al. | |
| 2009/0005188 | A1 * | 1/2009 | Iwatsubo et al. | 473/223 |
| 2009/0088275 | A1 | 4/2009 | Solheim et al. | |
| 2009/0088276 | A1 * | 4/2009 | Solheim et al. | 473/409 |
| 2009/0131189 | A1 | 5/2009 | Swartz et al. | |
| 2009/0131193 | A1 | 5/2009 | Swartz et al. | |
| 2010/0151956 | A1 * | 6/2010 | Swartz et al. | 473/199 |

OTHER PUBLICATIONS

Gregory J. Swartz, et al., "Methods, Apparatus, and Systems to Custom Fit Golf Clubs," U.S. Appl. No. 12/358,616, filed Jan. 23, 2009.

Gregory J. Swartz, et al., "Methods, Apparatus, and Systems to Custom Fit Golf Clubs," U.S. Appl. No. 12/358,463, filed Jan. 23, 2009.

Gregory J. Swartz, et al., "Methods, Apparatus, and Systems to Custom Fit Golf Clubs," U.S. Appl. No. 12/694,121, filed Jan. 26, 2010.

John K. Solheim, et al., "Methods, Apparatus, and Systems to Custom Fit Golf Clubs," U.S. Appl. No. 12/118,378, filed May 9, 2008.

* cited by examiner

1100

| Type | Club | Model | Carry Distance | Total Distance | Gap Distance |
|---|---|---|---|---|---|
| Measured | Lob wedge | A | 81 | 81 | - |
| Calculated | Sand wedge | A | 90 | 90 | 9 |
| Calculated | Pitching wedge | A | 110 | 111 | 20 |
| Calculated | 9-iron | B | 120 | 122 | 10 |
| Calculated | 8-iron | B | 130 | 135 | 10 |
| Calculated | 7-iron | B | 140 | 147 | 10 |
| Measured | 6-iron | B | 150 | 159 | 10 |
| Calculated | 5-iron | B | 160 | 170 | 10 |
| Calculated | 4-iron | B | 165 | 180 | 5 |
| Calculated | Hybrid 22° | C | 170 | 180 | 5 |
| Calculated | Hybrid 18° | C | 180 | 195 | 10 |
| Measured | Hybrid 15° | C | 185 | 205 | 5 |
| Calculated | 5-fairway wood | C | 190 | 205 | 5 |
| Calculated | 3-fairway wood | C | 210 | 230 | 20 |
| Measured | Driver | D | 240 | 260 | 30 |

1110

1120

1130

1140

FIG. 11

METHODS APPARATUS, AND SYSTEMS TO CUSTOM FIT GOLF CLUBS

CROSS REFERENCE TO RELATED APPLICATIONS

This application claims the benefit of U.S. Provisional Application 60/976,077, filed Sep. 28, 2007.

TECHNICAL FIELD

The present disclosure relates generally to sport equipment, and more particularly, to methods, apparatus, and systems to custom fit golf clubs.

BACKGROUND

To ensure an individual is playing with appropriate equipment, the individual may be custom fitted for golf clubs. In one example, the individual may be fitted for golf clubs (e.g., iron-type golf clubs) according to the custom fitting process developed by PING®, Inc. to match the individual with a set of golf clubs. As part of the custom fitting process developed PING®, Inc., for example, a color code system may be used to fit individuals of varying physical characteristics (e.g., height, wrist-to-floor distance, hand dimensions, etc.), swing tendencies (e.g., hook, slice, pull, push, etc.), and ball flight preferences (e.g., draw, fade, etc.) with iron-type golf clubs. With custom-fitted golf clubs, individuals may play golf to the best of their abilities.

BRIEF DESCRIPTION OF THE DRAWINGS

FIG. 11 depicts a visual diagram representation of another example display of the example fitting system of FIG. 1.

DESCRIPTION

In general, methods, apparatus, and articles of manufacture to custom fit golf clubs are described herein. The methods, apparatus, and articles of manufacture described herein are not limited in this regard.

Figure 1:
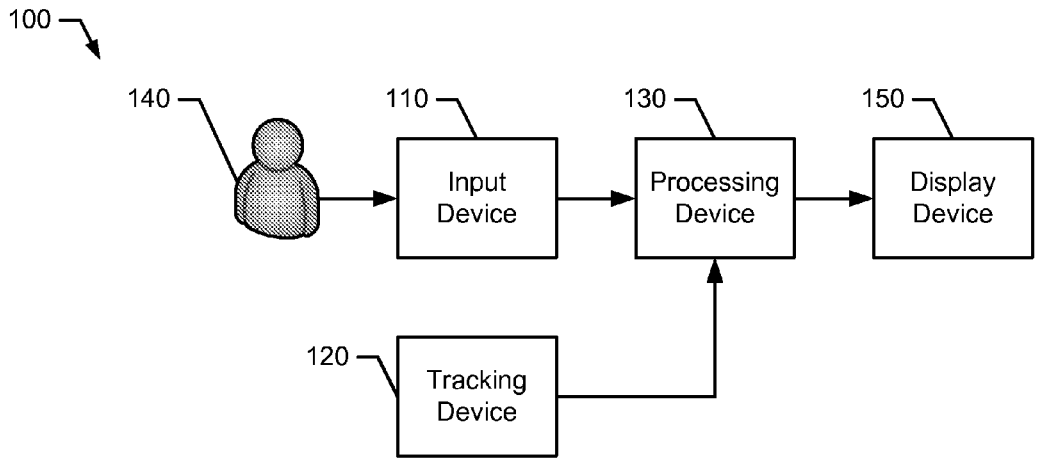
FIG. 1 is a block diagram representation of an example fitting system according to an embodiment of the methods, apparatus, systems, and articles of manufacture described herein.
Figure 2:
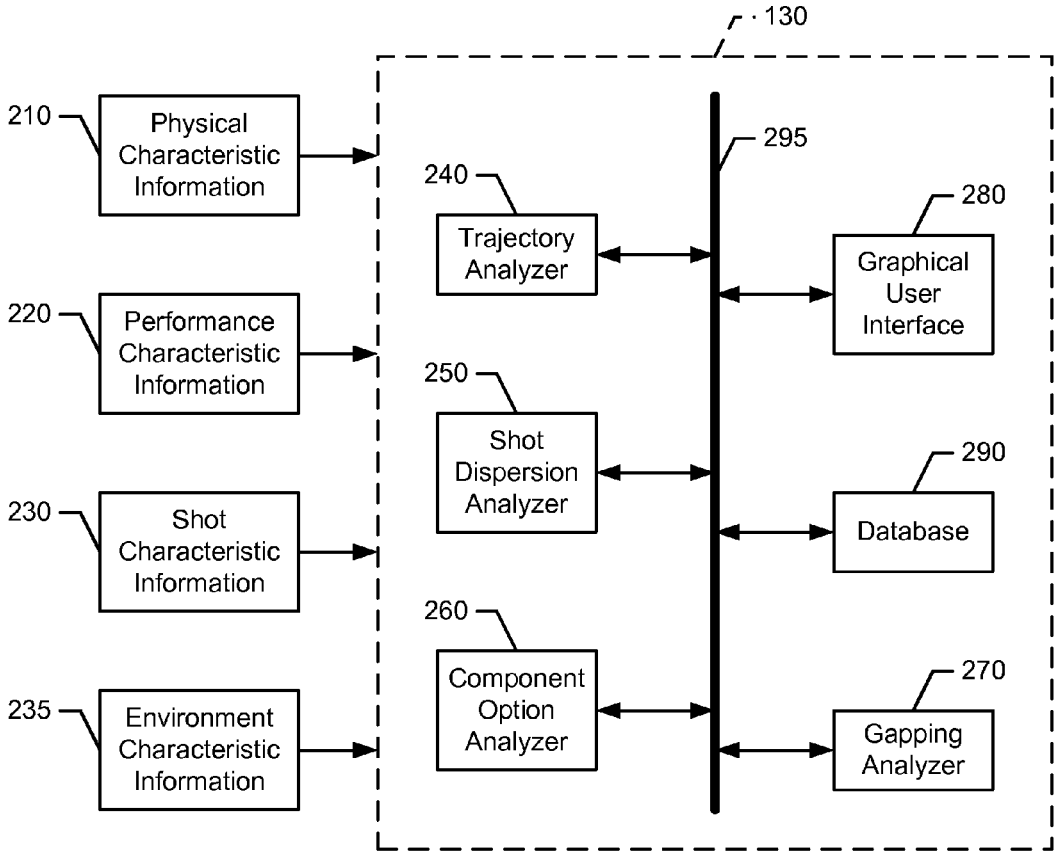
FIG. 2 depicts a block diagram representation of an example processing device of the example fitting system of FIG. 1.

In the example of FIGS. 1 and 2, a fitting system 100 may include an input device 110, a tracking device 120 (e.g., a ball launch monitor and/or a ball flight monitor), and a processing device 130. The input device 110 and the tracking device 120 may be coupled to the processing device 130 via a wireless connection and/or a wired connection. The fitting system 100 may be used to fit various golf clubs such as driver-type golf clubs, fairway wood-type golf clubs, hybrid-type golf clubs, iron-type golf clubs, wedge-type golf clubs, putter-type golf clubs, and/or any other suitable type of golf clubs.

In general, the input device 110 may assist in the interview portion of a custom fitting session. The input device 110 may be coupled to the processing device 130 so that information associated with physical and performance characteristics of an individual 140 being fitted for one or more golf clubs (e.g., physical characteristic information 210 and performance characteristic information 220 of FIG. 2) may be entered into the processing device 130 via the input device 110 (e.g., via one or more wired and/or wireless connections). In one example, the physical characteristic information 210 may include gender (e.g., male or female), age, dominant hand (e.g., left-handed or right-handed), hand dimension(s) (e.g., hand size, longest finger, etc. of dominant hand), height (e.g., head to toe), wrist-to-floor distance, and/or other suitable characteristics. The performance characteristic information 220 may include average carry distance of one or more golf clubs (e.g., average carry distance of a shot by the individual with a driver golf club, a 7-iron golf club, etc.), golf handicap, number of rounds played per a period of time (e.g., month, quarter, year, etc.), golf preferences (e.g., distance, direction, trajectory, shot pattern, etc.), and/or other suitable characteristics. The input device 110 may permit an individual to enter data and commands into the processing device 130. For example, the input device 110 may be implemented by a keyboard, a mouse, a touch-sensitive display, a track pad, a track ball, a voice recognition system, and/or other suitable human interface device (HID). The methods, apparatus, and systems described herein are not limited in this regard.

The tracking device 120 may measure characteristics associated with a shot of a golf ball with a particular golf club (e.g., shot characteristic information 230 of FIG. 2). To provide the processing device 130 with shot characteristic information 230, the tracking device 120 may be coupled to the processing device 130 via one or more wired and/or wireless connection(s). For example, the shot characteristic information 230 may include speed of the golf club during a shot, speed of a golf ball in response to impact with the golf club, launch angle of the golf ball in response to impact with the golf club, back spin of the golf ball in response to impact with the golf club, side spin of the golf ball in response to impact with the golf club, smash factor of the golf ball (e.g., the speed of the golf ball divided by the speed of the golf club head), total distance of the shot, bend of the shot (e.g., relative to an initial direction due to side spin), off-center distance of the shot, and/or other suitable shot characteristics. The methods, apparatus, and systems described herein are not limited in this regard.

The processing device 130 may include a trajectory analyzer 240, a shot dispersion analyzer 250, a component option analyzer 260, and a gapping analyzer 270. The processing device 130 may also include a graphical user interface 280 and a database 290. The trajectory analyzer 240, the shot dispersion analyzer 250, the component option analyzer 260, the gapping analyzer 270, the graphical user interface 280, and/or the database 290 may communicate with each other via a bus 295. As described in detail below, the processing device 130 may provide recommendations to custom fit the individual 140 with one or more golf clubs based on the physical characteristic information 210, the performance characteristic information 220, and/or the shot characteristic information 230. In general, the trajectory analyzer 240 may analyze the shot characteristic information 230 to generate a two-dimensional trajectory display (e.g., one shown as 320 of FIG. 5) and a three-dimensional trajectory display (e.g., one shown as 310 of FIG. 4). The shot dispersion analyzer 250 may analyze the shot characteristic information 230 to general a shot dispersion display (e.g., one shown as 330 of FIG. 6). The component option analyzer 260 may analyze the physical characteristic information 210, the performance characteristic information 220, and/or the shot characteristic information 230 to identify an optimal option for one or more components of a golf club. The gapping analyzer 270 may analyze the physical characteristic information 210, the performance characteristic information 220, and/or the shot characteristic information 230 to identify a set of golf clubs with substantially uniform gap distances between two neighboring golf clubs in the set and/or a progression in gap distances in the set (e.g., the gap distance between two neighboring golf clubs in the set may get wider or narrower through the set). The methods, apparatus, and systems described herein are not limited in this regard.

Although FIG. 2 may depict one or more components being separate blocks, two or more components of the processing device 130 may be integrated into a single block. While FIG. 2 may depict particular components integrated within the processing device 130, one or more components may be separate from the processing device 130. In one example, the database 290 may be integrated within a central server (not shown) and the processing device 130 may download information from the database 290 to a local storage device or memory (not shown). The methods, apparatus, and systems described herein are not limited in this regard.

Figure 3:
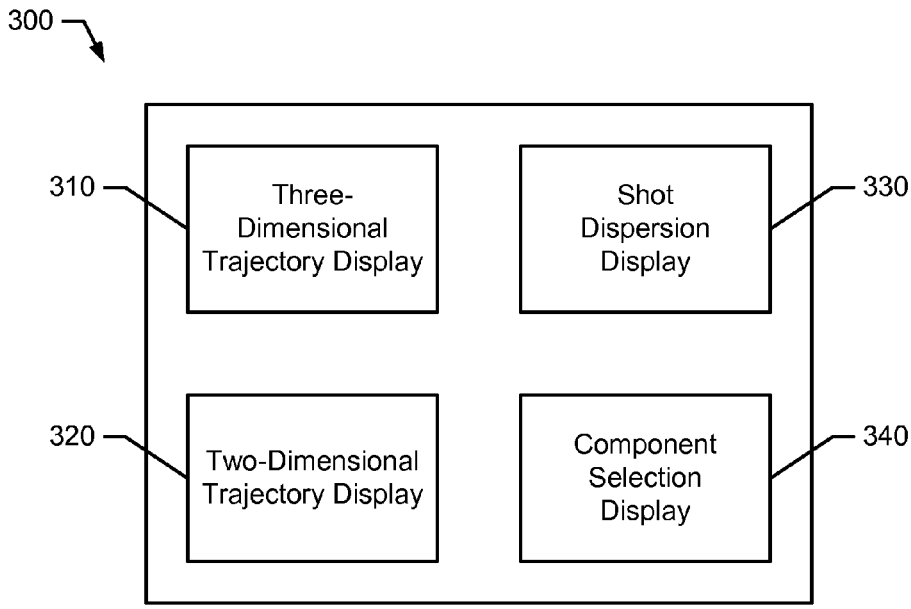
FIG. 3 depicts a visual diagram representation of an example display of the example fitting system of FIG. 1.

Turning to FIG. 3, for example, the graphical user interface 280 may generate a plurality of displays 300, generally shown as 310, 320, 330, and 340, simultaneously or concurrently. For example, the plurality of displays 300 may include a three-dimensional trajectory display 310, a two-dimensional trajectory display 320, a shot dispersion display 330, and a component option display 340. In general, the plurality of displays 300 may provide virtual depictions and/or information associated with a custom fitting session for golf clubs. Although FIG. 3 may depict a particular number of displays, the plurality of displays 300 may include more or less displays to provide virtual depictions and/or information associated with a custom fitting session for golf clubs. Further, while FIG. 3 may depict a particular configuration and size for the plurality of displays 300, the graphical user interface 280 may generate the plurality of displays 300 in other suitable configurations, sizes, etc. The methods, apparatus, and systems described herein are not limited in this regard.

Figure 4:
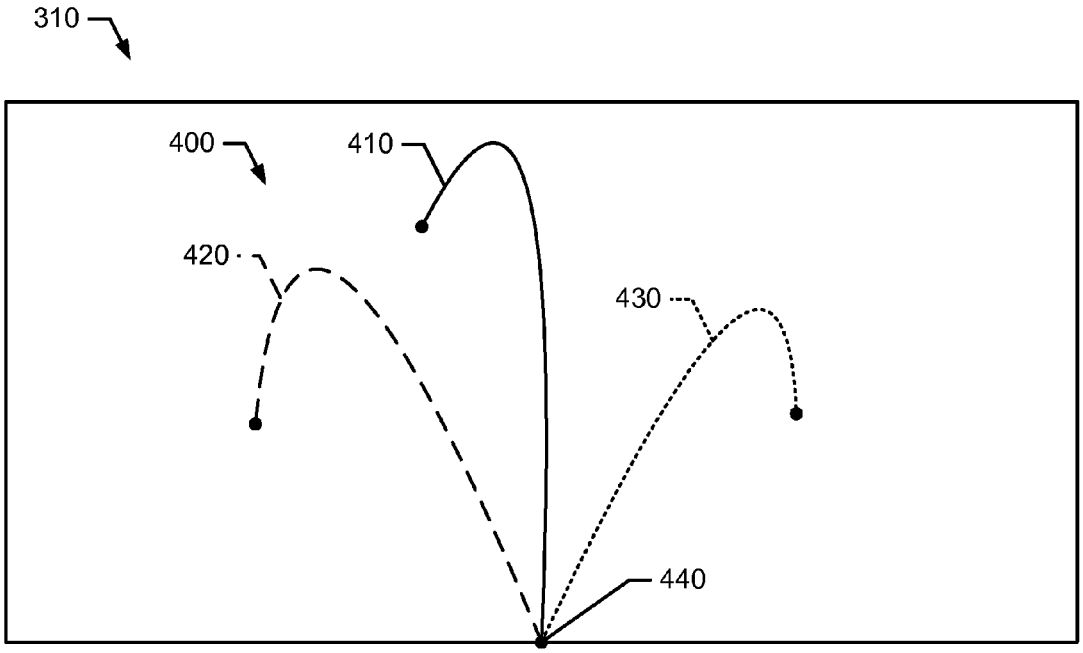
FIG. 4 depicts a visual diagram representation of another example display of the example fitting system of FIG. 1.

In the example of FIG. 4, the three-dimensional trajectory display 310 may generate one or more trajectories 400, generally shown as 410, 420, and 430, associated with a particular golf club from an initial location 440 of a golf ball. That is, the three-dimensional trajectory display 310 may generate the trajectories 400 from the perspective of the individual 140 striking the golf ball and/or someone located proximate to the individual 140. In one example, the three-dimensional trajectory display 310 may generate a first trajectory 410 indicative of a first shot of a golf ball using a particular golf club, a second trajectory 420 indicative of a second shot of a golf ball using the same golf club, and the third trajectory 430 indicative of a third shot of a golf ball using the same golf club.

Although FIG. 4 may depict the first trajectory 410, the second trajectory 420, and the third trajectory 430 in a solid line, a broken line, and a dashed line, respectively, the trajectories 400 may be depicted by colors and/or shading patterns. In one example, the first trajectory 410 may be indicated by a first color (e.g., red), the second trajectory 420 may be indicated by a second color (e.g., blue), and the third trajectory 430 may be indicated by a third color (e.g., yellow). In another example, the first trajectory 410 associated with a first golf club, the second trajectory 420 associated with a second golf club, and the third trajectory 430 may be associated with a third club. The first, second, and third golf clubs may be different from each other in one or more component options as described in detail below (e.g., model, loft, lie, shaft, length, grip, bounce, weight (e.g., swing weight), etc.). In particular, the first trajectory 410 may be indicative of an average of a number of shots associated with the first golf club. The second trajectory 420 may be indicative of an average of a number of shots associated with the second golf club. The third trajectory 430 may be indicative of an average of a number of shots associated with the third golf club. Accordingly, the first trajectory 410 may be depicted by a first color (e.g., red), the second trajectory 420 may be indicated by a second color (e.g., blue), and the third trajectory 430 may be indicated by a third color (e.g., yellow). Although the above examples may describe particular colors, the methods, apparatus, and systems described herein may be used in other suitable manners such as shading patterns.

In addition to trajectory information as described above, the three-dimensional trajectory display 310 may also provide environment information such as, for example, altitude, wind speed, humidity, and/or temperature of the location of the custom fitting session. While FIG. 4 and the above examples may depict and describe three trajectories, the methods, apparatus, and systems described herein may include more or less trajectories. The methods, apparatus, and systems described herein are not limited in this regard.

Figure 5:
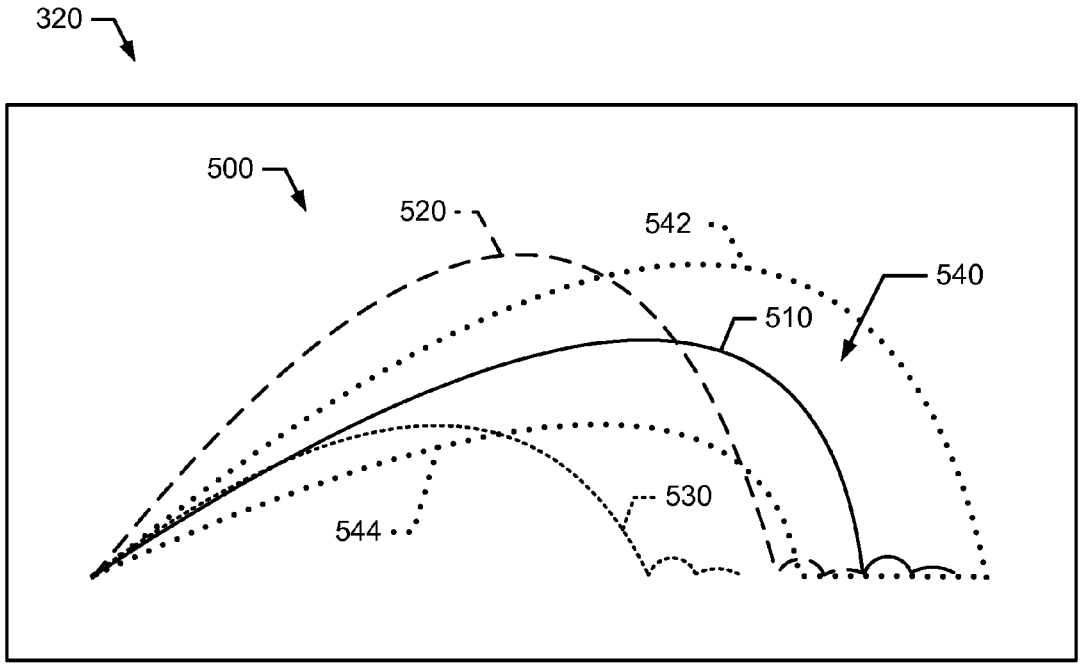
FIG. 5 depicts a visual diagram representation of another example display of the example fitting system of FIG. 1.

Referring to FIG. 5, for example, the two-dimensional trajectory display 320 may generate one or more trajectories 500, generally shown as 510, 520, and 530, relative to an optimal trajectory range 540. Although FIG. 5 may depict the optimal trajectory range 540 with dotted lines, the optimal trajectory range 540 may be depicted as a grayscale band. In particular, the optimal trajectory range 540 may be based on an optimal trajectory and a tolerance. An upper bound 542 and a lower bound 544 may define the tolerance relative to the optimal trajectory. The two-dimensional trajectory display 320 may provide a side view of the trajectories 500. In particular, each of the trajectories 500 may be indicative of a shot with a particular golf club. For example, the first trajectory 510 may be indicative of a trajectory of a first shot with a golf club. The second trajectory 520 may be indicative of a second shot with the same golf club. The third trajectory 530 may be indicative of a third shot with the same golf club. Alternatively, each of the trajectories 500 may be indicative of an average of a number of shots associated with a golf club. For example, the first trajectory 510 may be indicative of an average of a number of shots associated with a first golf club. The second trajectory 520 may be indicative of an average of a number of shots associated with a second golf club (e.g., different from the first golf club). The third trajectory 530 may be indicative of an average of a number of shots associated with a third golf club (e.g., different from the first and second golf clubs). In particular, the first, second, and third golf clubs may be different from each other in one or more component options as described in detail below (e.g., model, loft, lie, shaft, length, grip, bounce, weight, etc.). The optimal trajectory range 540 may be indicative of a target range for an individual with particular swing parameters (e.g., swing speed, ball speed, etc.). Accordingly, the trajectories 500 may be compared to the optimal trajectory range 540.

In addition to the trajectory information described above, the two-dimensional trajectory display 320 may also provide shot information associated with each shot such as, for example, club speed, ball speed, smash factor, launch angle, back spin, side spin, vertical landing angle, offline distance, and carry distance. Further, the two-dimensional trajectory display 320 may expand or hide the shot information associated with a set of shots. The methods, apparatus, and systems described herein are not limited in this regard.

Figure 6:
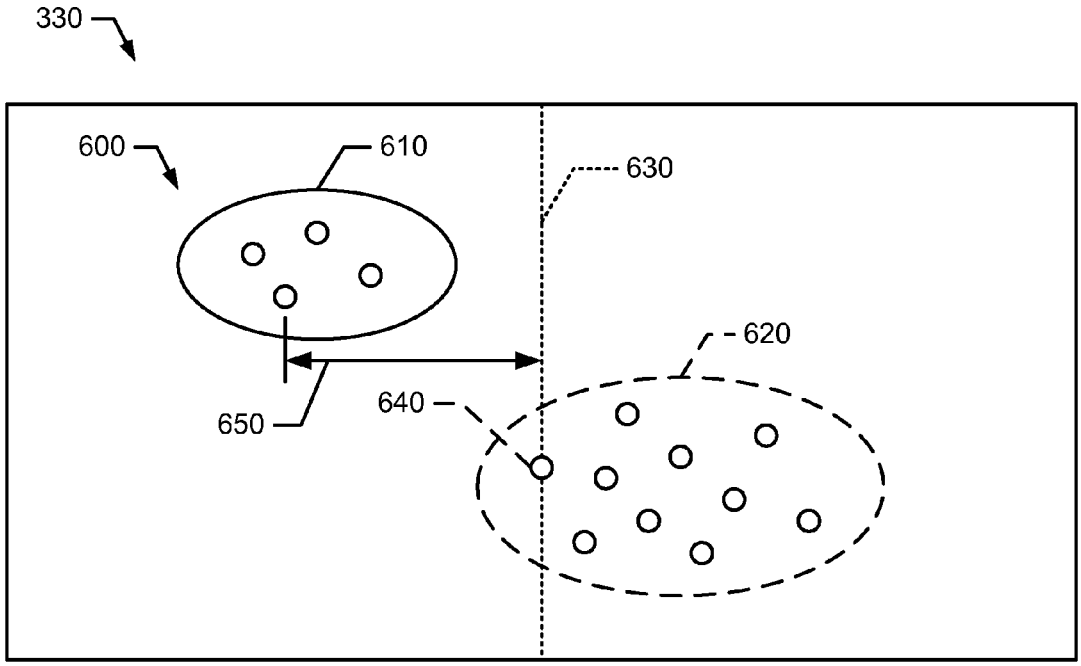
FIG. 6 depicts a visual diagram representation of another example display of the example fitting system of FIG. 1.

Turning to FIG. 6, for example, the shot dispersion display 330 may generate one or more perimeters 600 associated with shot dispersions, generally shown as 610 and 620. Each of the perimeters 600 may be indicative of two or more shots taken with a particular golf club (e.g., visual measures of dispersion). Further, each perimeter may encompass a particular percentage of shots within an area (e.g., 90%) whereas a number of shots may fall outside of that particular perimeter (e.g., 10%).

In one example, the shot dispersion display 330 may generate a first perimeter 610 to inscribe a number of shots associated with a first golf club, and a second perimeter 620 to inscribe a number of shots associated with a second golf club (e.g., different from the first golf club). In particular, the first and second golf clubs may be different from each other in one or more component options as described in detail below (e.g., model, loft, lie, shaft, length, grip, bounce, weight, etc.). The first perimeter 610 may be indicated by a first color (e.g., blue) whereas the second perimeter 620 may be indicated by a second color (e.g., red).

The shot dispersion display 330 may provide a center line 630 to depict a substantially straight shot (e.g., one shown as 640). The center line 630 may be used to determine an offline distance 650 of each shot. A shot to the left of the center line 630 may be a hook shot, a draw shot, or a pull shot whereas a shot to the right of the center line 630 may be a slice shot, a fade shot, or a push shot. For example, shots inscribed by the first perimeter 610 may include hook shots, draw shots, and/or pull shots. Shots inscribed by the second perimeter 620 may include draw shots, slice shots, or fade shots, and/or push shots.

Although FIG. 6 may depict the perimeters having elliptical shapes, the methods, apparatus, and systems described herein may include perimeters with other suitable shapes (e.g., circular, rectangular, etc.). The methods, apparatus, and systems described herein are not limited in this regard.

The component option display 340 may provide one or more options associated with one or more components of a golf club. In one example, the component option display 340 may depict one or more models of driver-type golf clubs offered by a manufacturer based on the physical characteristic information, the performance characteristic information, and/or shot characteristic information associated with the individual 140. In particular, the component option analyzer 260 may identify a particular model based on swing speed of a golf club and gender of the individual 140 (e.g., model options). Based on the selected model option, the component option analyzer 260 may identify one or more lofts offered by the manufacturer with the selected model option (e.g., loft options). The component option analyzer 260 may also provide one or more type of shafts (e.g., regular, stiff, extra stiff, and soft) associated with the selected model option and the selected loft option (e.g., shaft options). For example, the component option analyzer 260 may identify shaft options based on swing speed of the individual 140. Based on the selected model option, the selected loft option, and the selected shaft option, the component option analyzer 260 may identify one or more lengths associated with the selected model option, the selected loft option, and the selected shaft option. Further, the component option analyzer 260 may identify one or more grips associated with the selected model option, the selected loft option, the selected shaft option, and the selected length option. For example, the component option analyzer 260 may identify a relatively thinner grip so that the individual 140 may generate a less-curved ball flight (e.g., less side spin) if the individual 140 is hitting the golf ball with a slice trajectory but would like to have a straight trajectory. The methods, apparatus, and systems described herein are not limited in this regard.

The component option analyzer 260 and/or the component option display 340 may be used in connection with an interchangeable club head and shaft system to identify optimal options of each component of a golf club. By changing to various options of a particular component of a golf club while keeping other components of the golf club unchanged, the component option analyzer 260 may determine the optimal option for that particular component. In one example, various club heads with different lofts of the same model may be used to determine the optimal loft option for an individual.

To provide the individual 140 with a virtual experience during a fitting session, the processing device 130 may also receive environment characteristic information 235 (FIG. 1) via the input device 110. Accordingly, the processing device 130 (e.g., via the plurality of displays 300) may generate visual representation(s) of the environment in which the individual 140 may play a round of golf. For example, the environment characteristic information 235 may include golf ball conditions (e.g., brand of golf balls (such as premium quality golf balls or non-premium quality golf balls), construction of golf balls (such as two-piece balls, multi-layer balls, etc.), type of golf balls (such as distance balls, spin control balls, etc.), cover of golf balls (such as surlyn cover, urethane cover, etc.), weather conditions (such as temperature, humidity, wind, etc.), golf course conditions (such as altitude of a golf course, fairway surface condition of the golf course, green surface condition of the golf course, etc.) and/or other suitable environment conditions during a round of golf.

In one example, the individual 140 may typically play on golf courses located in relatively high-altitude areas but the location of the fitting session may be located in a relatively low-altitude area. Accordingly, the processing device 130 (e.g., via the input device 110) may receive the environment characteristic information 235 such as an approximate altitude of those golf courses so the trajectory analyzer 240 and/or the shot dispersion analyzer 250 may generate visual representations on the plurality of displays 300 based on the approximate altitude during the fitting session. As a result, the processing device 130 may use the shot characteristic information 230 (e.g., via the tracking device 120) and the environment characteristic information 235 to generate the trajectories 400 on the three-dimensional trajectory display 310, the trajectories 500 on the two-dimensional trajectory display 320, and/or the perimeters 600 on the shot dispersion display 330.

In another example, the individual 140 may typically use a particular brand of premium quality golf balls during a round of golf. Although the individual 140 may be hitting non-premium quality golf balls (e.g., driving range golf balls) during the fitting session, the processing device 130 (e.g., via the trajectory analyzer 240 and/or the shot dispersion analyzer 250) may provide virtual representations as if the individual 140 was using the particular brand of premium quality golf balls during the fitting session. For example, the individual 140 may be hitting non-premium quality golf balls during the fitting session but the trajectory analyzer 240 may use data associated with the particular brand of premium quality golf balls in conjunction with the shot characteristic information 230 to generate the trajectories 400 on the three-dimensional trajectory display 310 and/or the trajectories 500 on the two-dimensional trajectory display 320. The methods, apparatus, and systems described herein are not limited in this regard.

Although the above examples may describe the fitting system 100 to custom fit the individual 140 with golf clubs, the methods, apparatus, and systems described herein may be used in other suitable manners. In addition or in place of the component option display 340, for example, the processing device 130 may provide a multi-media display for informative or educational purposes. For example, the multi-media display may provide a video described various aspect of a golf club, the game of golf, etc. Thus, the processing device 130 may provide an informational or educational analysis instead of providing recommendations for one or more golf clubs.

Figure 7:
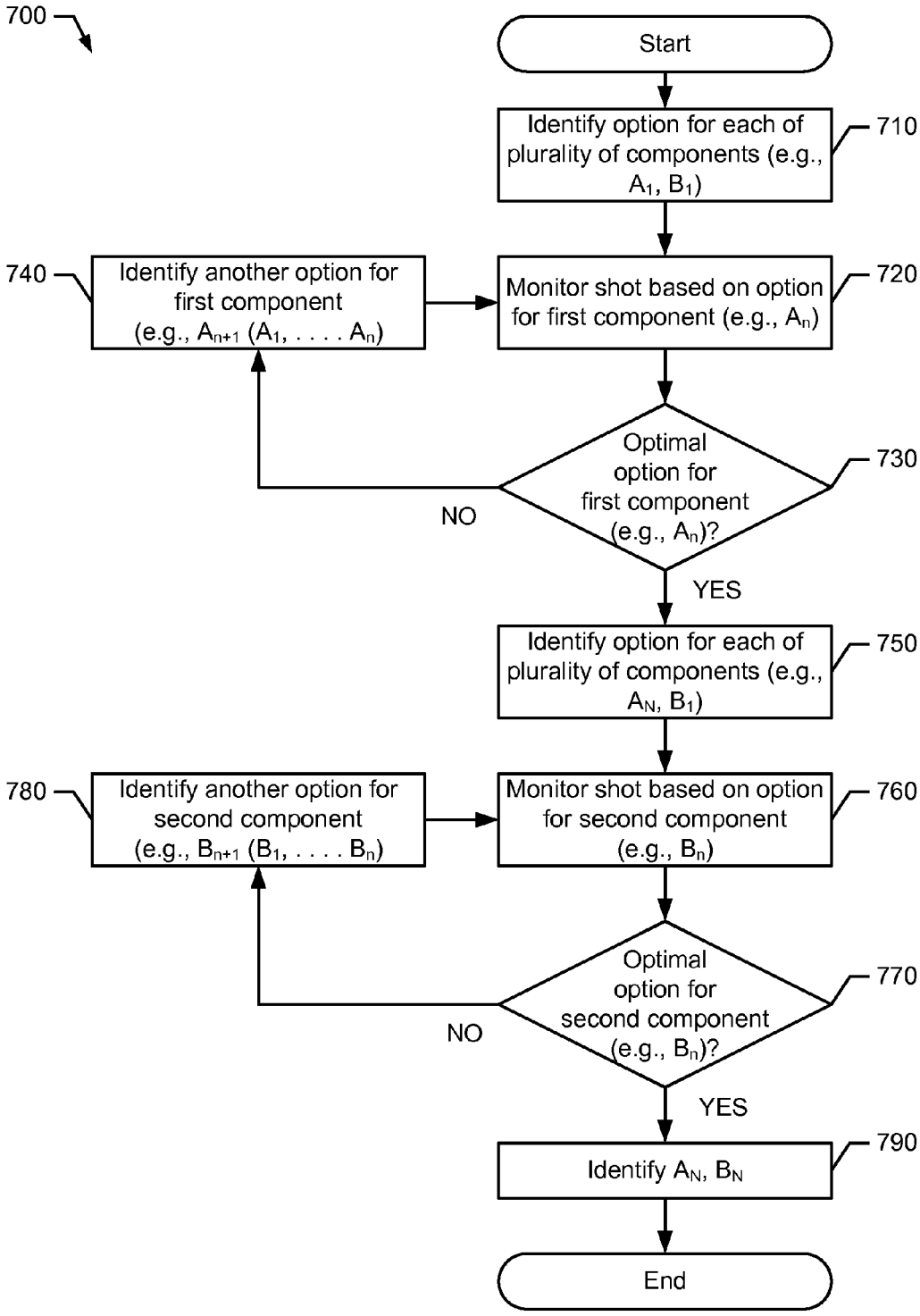
FIG. 7 depicts a flow diagram representation of one manner in which the example processing device of FIG. 2 may operate.

FIG. 7 depicts one manner in which the processing device 130 of FIG. 1 may be configured to identify components of a golf club to the individual 140 based on the physical characteristic information 210, the performance characteristic information 220, and/or the shot characteristic information 230 associated with the individual 140. The example process 700 may be implemented as machine-accessible instructions utilizing any of many different programming codes stored on any combination of machine-accessible media such as a volatile or nonvolatile memory or other mass storage device (e.g., a floppy disk, a CD, and a DVD). For example, the machine-accessible instructions may be embodied in a machine-accessible medium such as a programmable gate array, an application specific integrated circuit (ASIC), an erasable programmable read only memory (EPROM), a read only memory (ROM), a random access memory (RAM), a magnetic media, an optical media, and/or any other suitable type of medium.

Further, although a particular order of actions is illustrated in FIG. 7, these actions can be performed in other temporal sequences. Again, the example process 700 is merely provided and described in conjunction with the processing device 130 of FIGS. 1 and 2 as an example of one way to recommend a golf club to the individual 140. The example process 700 may also be used with an interchangeable component system (e.g., interchangeable club head/shaft system) to provide different combinations of options for various components of a golf club (e.g., model, loft, lie, shaft, length, grip, bounce, and/or weight).

In the example of FIG. 7, the process 700 (e.g., via the processing device 130 of FIGS. 1 and 2) may begin with identifying an option for each of a plurality of components of a golf club (block 710). In general, the process 700 may isolate each of the plurality components to determine the optimal option for each of the plurality of components. That is, the individual 140 may take one or more shots at a golf ball with a golf club including the first option of the first component. In one example, the fitting system 100 (FIG. 1) may be fitting the individual 140 for a driver-type golf club. Accordingly, the component option analyzer 230 may identify a particular model for the individual 140 based on the physical characteristic information 210 and the performance characteristic information 220). The process 700 may monitor (e.g., via the tracking device 120 of FIG. 1) one or more shots based on a first option of the first component (e.g., $A_1$) (block 720).

Based on the shot result from block 720, the component option analyzer 230 may determine whether the first option (e.g., $A_1$) is an optimal option for the first component (block 730). If the first option is not the optimal option for the first component, the process 700 may proceed to identify a second option of the first component (e.g., $A_2$) (block 740). The process 700 may continue as described above until the component option analyzer 260 identifies an optimal option for the first component (e.g., $A_N$).

Turning back to block 730, if the first option is the optimal option for the first component, the process 700 may proceed to identify an option for the second component based on the optimal option for the first component (block 750). Following the above example, the process 700 may determine an optimal loft associated with the optimal model. The process 700 may monitor (e.g., via the launch monitor 120 of FIG. 1) one or more shots based on a first option of the second component (e.g., $B_1$) (block 760).

Based on the shot result from block 760, the component option analyzer 230 may determine whether the first option (e.g., $B_1$) is an optimal option for the second component (block 770). If the first option is not the optimal option for the second component, the process 700 may proceed to identify a second option of the second component (e.g., $B_2$) (block 780). The process 700 may continue as described above until the component option analyzer 260 identifies an optimal option for the second component (e.g., $B_N$).

Turning back to block 770, if the first option is the optimal option for the second component, the process 700 may proceed to identify the optimal options for first and second components (e.g., $A_N$, $B_N$) (block 790).

Although FIG. 7 may depict identifying optimal options for two components, the methods, apparatus, and systems described herein may identify optimal options for more than two components. While a particular order of actions is illustrated in FIG. 7, these actions may be performed in other temporal sequences. For example, two or more actions depicted in FIG. 7 may be performed sequentially, concurrently, or simultaneously. The methods, apparatus, and systems described herein are not limited in this regard.

Figure 8:
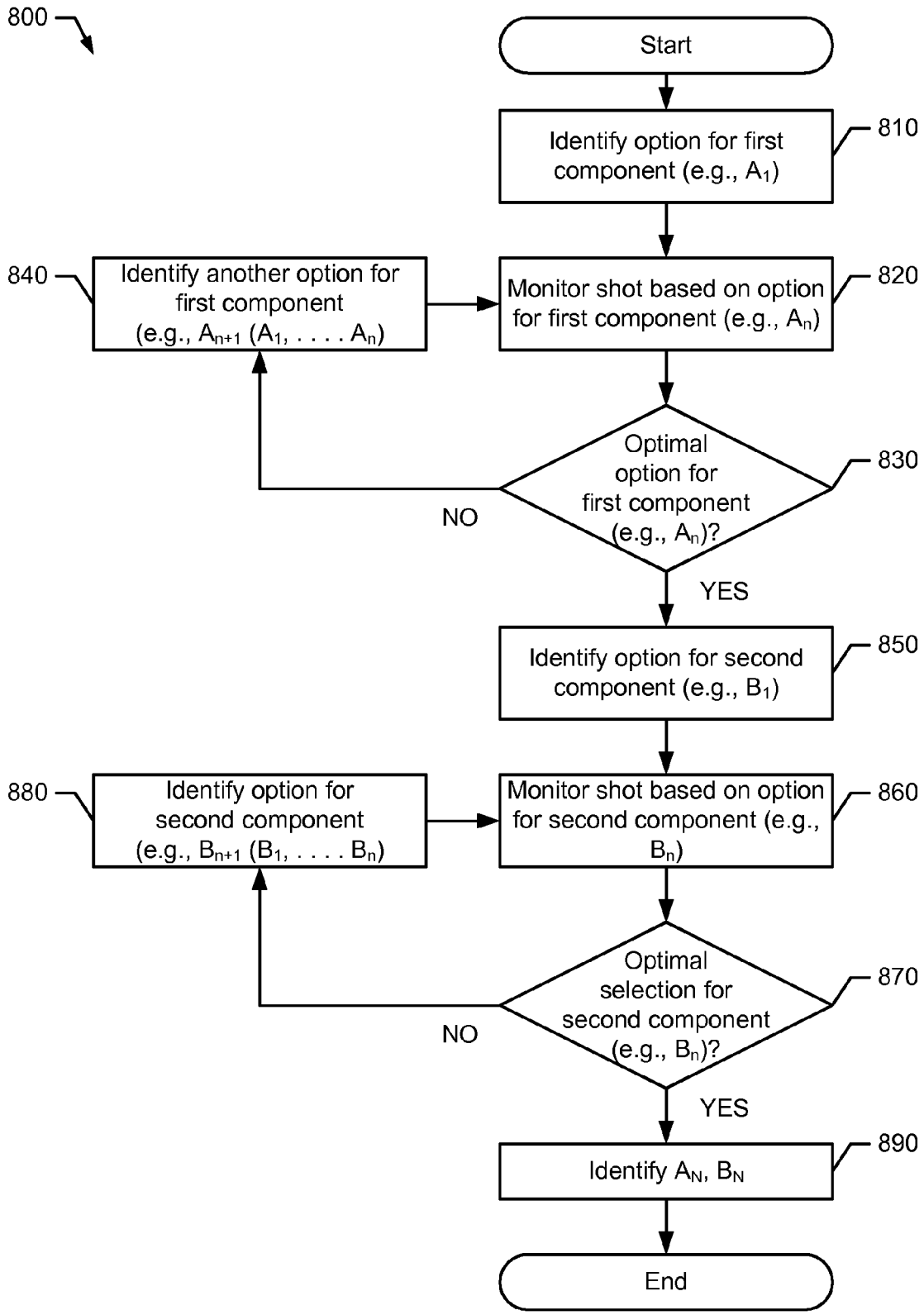
FIG. 8 depicts a flow diagram representation of another manner in which the example processing device of FIG. 2 may operate.

As noted above, the process 700 may initially identify an optimal option of an initial component. In response to identifying the optimal option of the initial component, the process 700 may identify an optimal option of a subsequent component based on the optimal option of the initial component. Alternatively as illustrated in FIG. 8, a process 800 may identify an optimal option of a component independent of an optimal option of another component. The process 800 may begin with identifying an option for each of a plurality of components of a golf club (block 810). The process 800 may monitor (e.g., via the launch monitor 120 of FIG. 1) one or more shots based on a first option of the first component (e.g., $A_1$) (block 820).

Based on the shot result from block 820, the component option analyzer 230 may determine whether the first option (e.g., $A_1$) is an optimal option for the first component (block 830). If the first option is not the optimal option for the first component, the process 800 may proceed to identify a second option of the first component (e.g., $A_2$) (block 840). The process 800 may continue as described above until the component option analyzer 260 identifies an optimal option for the first component (e.g., $A_N$).

Turning back to block 830, if the first option is the optimal option for the first component, the process 800 may proceed to identify an option for the second component independent of the optimal option for the first component (block 850). The process 800 may monitor (e.g., via the launch monitor 120 of FIG. 1) one or more shots based on a first option of the second component (e.g., $B_1$) (block 860).

Based on the shot result from block 860, the component option analyzer 230 may determine whether the first option (e.g., $B_1$) is an optimal option for the second component (block 870). If the first option is not the optimal option for the second component, the process 800 may proceed to identify a second option of the second component (e.g., $B_2$) (block 880). The process 800 may continue as described above until the component option analyzer 260 identifies an optimal option for the second component (e.g., $B_N$).

Turning back to block 870, if the first option is the optimal option for the second component, the process 800 may proceed to identify the optimal options for the first and second components (e.g., $A_N$, $B_N$) (block 890).

Although FIG. 8 may depict identifying optimal options for two components, the methods, apparatus, and systems described herein may identify optimal options for more than two components. While a particular order of actions is illustrated in FIG. 8, these actions may be performed in other temporal sequences. For example, two or more actions depicted in FIG. 8 may be performed sequentially, concurrently, or simultaneously. The methods, apparatus, and systems described herein are not limited in this regard.

Figure 9:
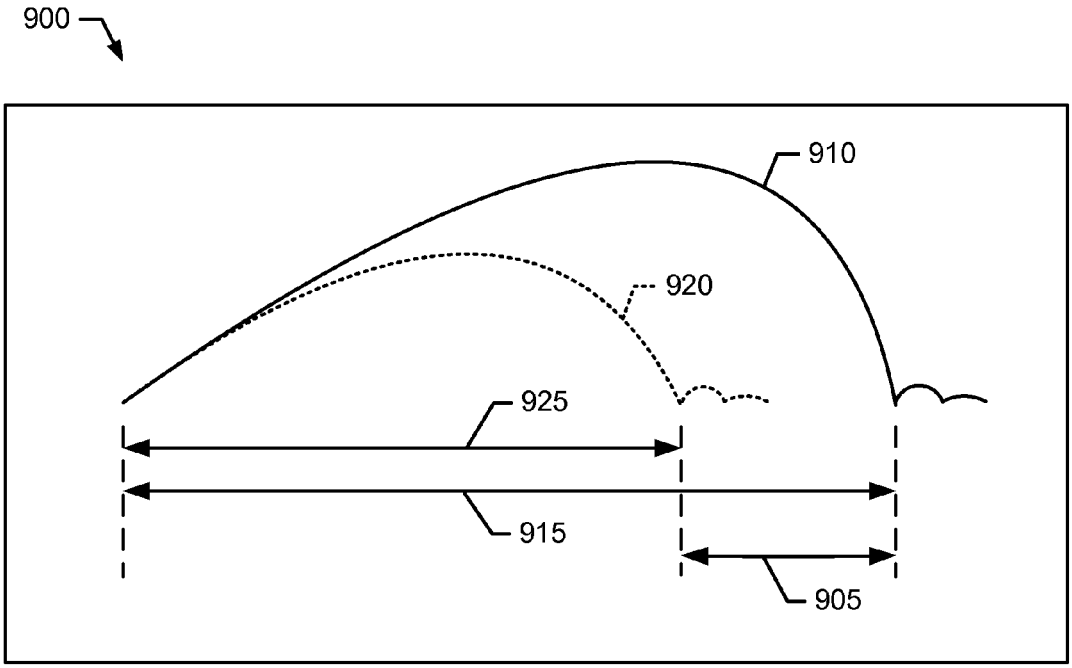
FIG. 9 depicts a visual diagram representation of another example display of the example fitting system of FIG. 1.
Figure 10:
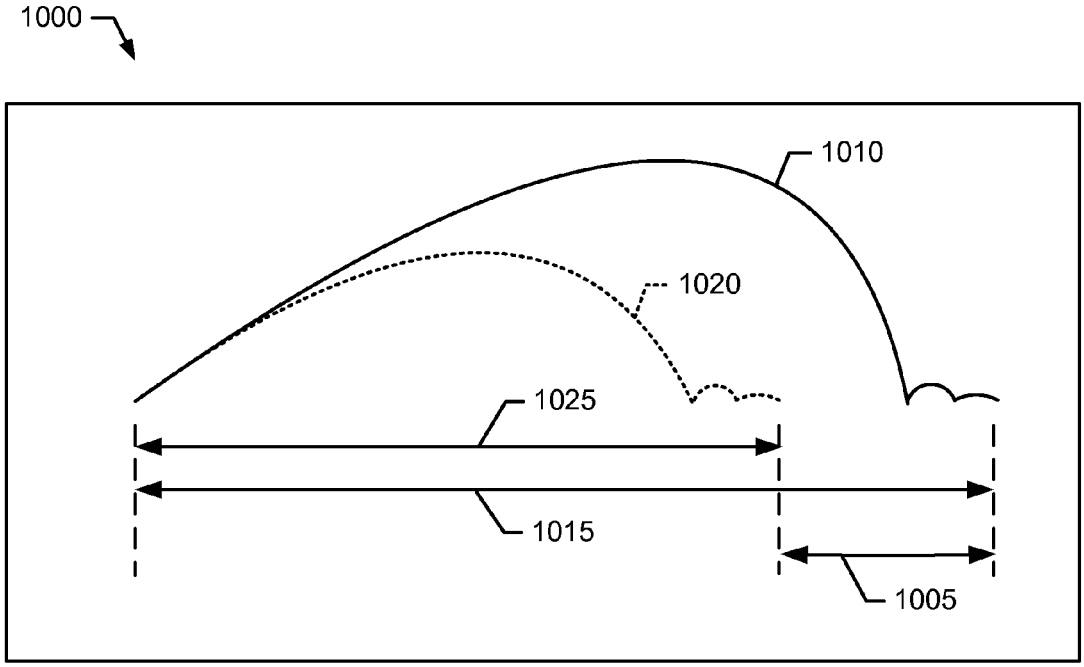
FIG. 10 depicts a visual diagram representation of another example display of the example fitting system of FIG. 1.

In the example of FIGS. 9 and 10, the processing device 130 may generate one or more gapping analysis displays, generally shown as 900 and 1000, respectively. Each of the gapping analysis displays 900 and 1000 may provide visual representation of at least one gap distance, generally shown as 905 and 1005, respectively, between two shots using different golf clubs (e.g., two golf clubs within a set). The gap distance 905 may be a distance between carry distances between two shots taken with two different golf clubs. In one example, the individual 140 may strike a golf ball with a 6-iron golf club for 150 yards whereas the individual 140 may strike a golf ball with a 5-iron golf club for 160 yards. Accordingly, the gap distance 905 between the 5-iron and 6-iron golf clubs may be ten yards. Further, carry distance, generally shown as 910 and 920 of FIG. 9, may be a distance traveled by a golf ball from impact with a golf club to landing. As a result, the gap distance 905 may be a distance between the carry distance 910 associated with a first shot 915 and the carry distance 920 associated with a second shot 925. The methods, apparatus, and systems described herein are not limited in this regard.

Alternatively as illustrated in FIG. 10, the gap distance 1005 may be a distance between total distances between two shots taken with two different golf clubs. In particular, the gap distance 1005 may be a distance between total distances between two shots taken with two different golf clubs. Total distance, generally shown as 1010 and 1020, may be the carry distance 920 and 930, respectively, plus a distance traveled by the golf ball after landing to a final resting position. As a result, the gap distance 1005 may be a distance between the total distance 1010 associated with a first shot 915 and the total distance 1020 associated with a second shot 925. The methods, apparatus, and systems described herein are not limited in this regard.

Golf ruling bodies may define the number of golf clubs available to the individual 140 during a round of golf (e.g., the number of golf clubs that the individual 140 may carry in a golf bag). For example, the individual 140 may be permitted to carry up to fourteen clubs in his/her bag. However, the individual 140 may not be able to use all fourteen clubs effectively. As described in detail below, maintaining consistent gaps between the spectrum of golf clubs in a set (e.g., fairway wood-type golf clubs, hybrid-type golf clubs, iron-type golf clubs, wedge-type golf clubs, etc.) may assist the performance of the individual 140. Alternatively, the individual 140 may have, use, and/or purchase more than fourteen golf clubs to have alternative options based on course conditions.

In general, the gapping analyzer 270 (FIG. 2) may analyze the physical characteristic information 210, the performance characteristic information 220, and/or the shot characteristic information 230 to provide a set of golf clubs with consistent gaps. In addition to swing speed of the individual 140, the gapping analyzer 270 may use the shot characteristic information 230 such as ball speed, ball launch angle, and ball spin rate of two or more shots associated with two or more golf clubs to calculate and extrapolate ball launch parameters (e.g., ball speed, ball launch angle, ball spin rate, etc.) for other golf clubs that the individual 140 may use. In one example, the individual 140 may take two or more shots with a first golf club (e.g., 7-iron). The individual 140 may also take two or more shots with a second golf club (e.g., hybrid 22°). Based on the shot characteristic information 230 of these shots and reference data of golf clubs that were not use by the individual 140 to take any shots during the fitting process, the gapping analyzer 270 may estimate ball launch parameters of various golf clubs for the individual 140. For example, the reference data may be calculated and/or measured from shots taken by other individuals. The reference data may be stored in a database 290 (FIG. 2). The methods, apparatus, and systems described herein are not limited in this regard.

Referring to FIG. 11, for example, the gapping analyzer 270 may identify a plurality of golf clubs to complete a set associated with a substantially uniform gap distance. In one example, a gap distance may be the difference between two carry distances of two neighboring clubs. In particular, the gapping analyzer 270 may identify twelve golf clubs of a set with a substantially uniform gap distance between two neighboring golf clubs of the set (e.g., excluding a driver-type golf club and a putter-type golf club). Following the above example, the gap distance 1110 between the 8-iron golf club and the 7-iron golf club for the individual 140 may be ten yards (e.g., the carry distances are 130 and 140 yards, respectively). Accordingly, the substantially uniform gap distance between two neighboring golf clubs of the set may also be about ten yards as well. In one example, the gap distance 1120 between the 7-iron golf club and the 6-iron golf club may be ten yards (e.g., the carry distances are 140 and 150 yards, respectively). In a similar manner, the gap distance 1130 between the 6-iron golf club and the 5-iron golf club may also be ten yards (e.g., the carry distances are 150 and 160 yards, respectively).

In contrast to the gap distances 1110, 1120, and 1130, the gap distance 1140 between the 5-iron golf club and the 4-iron golf club for the individual 140 may be less than the substantially uniform gap distance of ten yards. Accordingly, the gapping analyzer 270 may identify a hybrid-type golf club instead of a 4-iron golf club to the individual 140 because the gap distance 1140 between the 5-iron golf club and the 4-iron golf club is less than the uniform gap distance of ten yards. To maintain a ten-yard gap distance between the 5-iron type golf club and the next golf club within the set, the gapping analyzer 270 may identify the hybrid 22° golf club because the gap distance between the 5-iron golf club and the hybrid 22° golf club may be ten yards (e.g., the carry distances for the 5-iron golf club and the hybrid 22° golf club are 160 and 170 yards, respectively). In another example, the gapping analyzer 270 may identify the hybrid 18° golf club instead of the hybrid 15° golf club because the gap distance between the hybrid 22° golf club and the hybrid 18° golf club may be ten yards (e.g., the carry distances are 170 and 180 yards, respectively) whereas the gap distance between the hybrid 22° golf club and the hybrid 15° golf club may be fifteen yards (e.g., the carry distances are 170 and 185 yards, respectively). By using the shot characteristic information 230 (e.g., ball speed, ball launch angle, ball spin rate, etc.) in addition to swing speed of the individual 140, the gapping analyzer 270 may provide substantially uniform gap distances between two neighboring golf clubs within a set.

Alternatively, the gapping analyzer 270 may identify a progression in gap distances in a set of golf clubs (e.g., the gap distance between two neighboring golf clubs in the set may get wider or narrower through the set). In particular, the gapping analyzer 270 may identify a first gap distance for a first group of golf clubs in the set and a second gap distance for second group of golf clubs in the same set. In one example, the gapping analyzer 270 may identify the first gap distance of eight yards for the wedge-type golf clubs in a set, and a second gap distance of ten yards for the iron-type golf clubs. Further, the gapping analyzer 270 may identify a third gap distance of 15 yards for the fairway wood-type golf clubs.

Although the above example may describe the gap distance as the difference between two carry distances of two neighboring clubs, the gap distance may be the difference between two total distances of two neighboring clubs. The methods, apparatus, and systems described herein are not limited in this regard.

Figure 12:
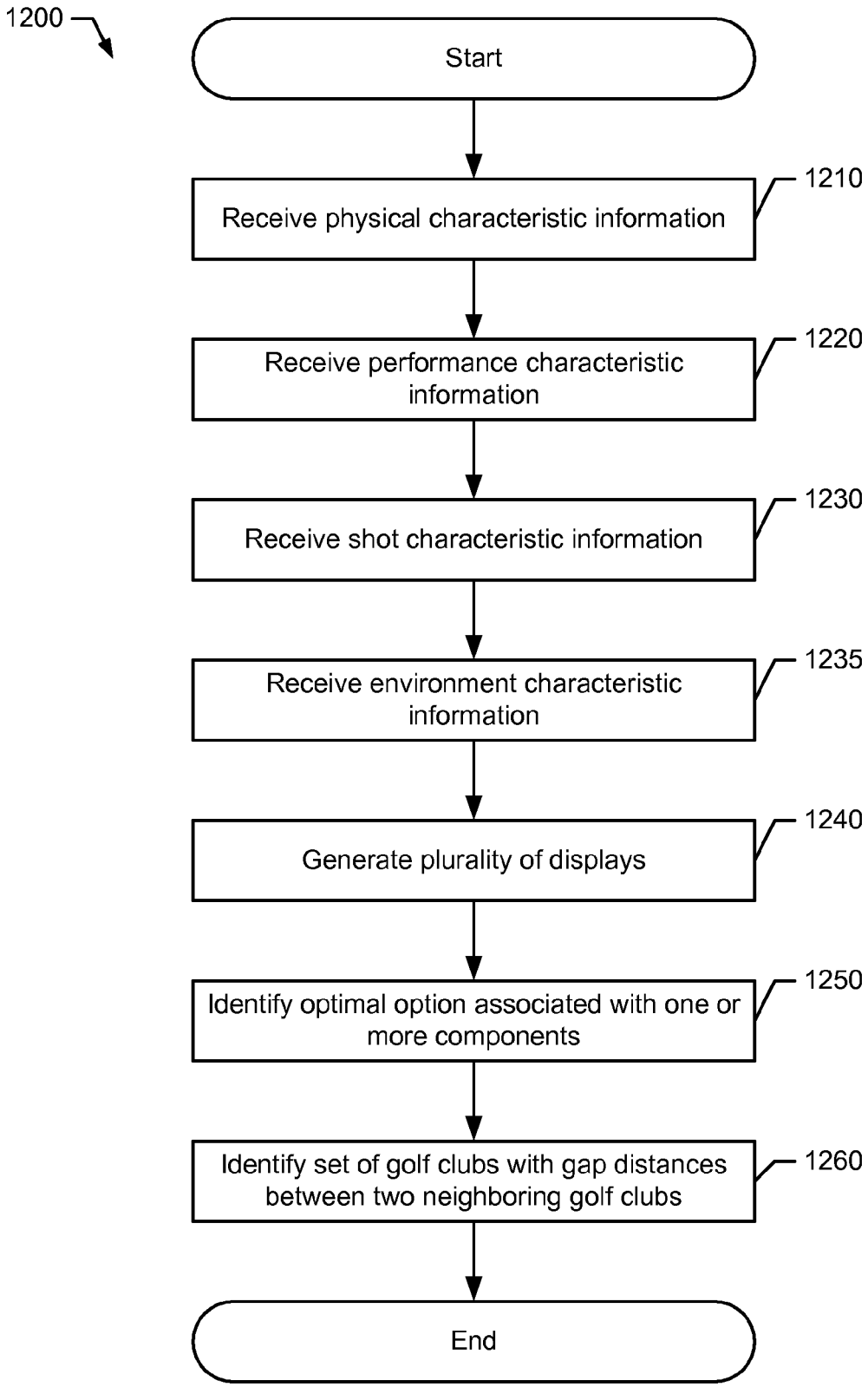
FIG. 12 depicts a flow diagram representation of one manner in which the example fitting system of FIG. 1 may operate.

In the example of FIG. 12, a process 1200 may begin with receiving the physical characteristic information 210 associated with the individual 140 (e.g., via the input device 110) (block 1210). The process 1200 may also receive the performance characteristic information 220 associated with the individual 140 (e.g., via the input device 110) (block 1220). In addition, the process 1200 may receive the shot characteristic information 230 associated with the individual 140 (e.g., via the tracking device 120) (block 1230). Further, the process 1200 may receive the environment characteristic information 235 associated with the individual 140 (e.g., via the tracking device 120) (block 1235).

Based on the physical characteristic information 210, the performance characteristic information 220, the shot characteristic information 230, and/or the environment characteristic information 235, the process 1200 (e.g., via the trajectory analyzer 240, the shot dispersion analyzer 250, the component option analyzer 260, and/or the graphical user interface 280) may generate the plurality of displays 300 (block 1240). In addition, the process 1200 (e.g., via the component option analyzer 260) may identify an optimal option associated with one or more components of a golf club (block 1250). Further, the process 1200 (e.g., via the gapping analyzer 270) may identify a set of golf clubs with gap distances between two neighboring golf clubs in the set (block 1260). As noted above, the gap distances may be substantially uniform throughout the set of golf clubs. Alternatively, the gap distances may increase or decrease progressively based on the type of golf clubs throughout the set of golf clubs.

While a particular order of actions is illustrated in FIG. 12, these actions may be performed in other temporal sequences. For example, two or more actions depicted in FIG. 12 may be performed sequentially, concurrently, or simultaneously. Further, one or more actions depicted in FIG. 12 may not be performed at all. In one example, the process 1200 may not perform the block 1260 (e.g., the process 1200 may end after block 1250). The methods, apparatus, systems, and articles of manufacture described herein are not limited in this regard.

Although certain example methods, apparatus, systems, and/or articles of manufacture have been described herein, the scope of coverage of this disclosure is not limited thereto. On the contrary, this disclosure covers all methods, apparatus, systems, and/or articles of manufacture fairly falling within the scope of the appended claims either literally or under the doctrine of equivalents.

What is claimed is:

1. A method comprising:

receiving at a processing device physical characteristic information, performance characteristic information, and shot characteristic information associated with an individual; and calculating, with the processing device, optimized club components for an optimized golf club for the individual;

wherein:

the shot characteristic information is received at a trajectory analyzer of the processing device from a tracking device configured to be coupled to the processing device;

the optimized club components are calculated by a component option analyzer of the processing device;

calculating the optimized club components with the component option analyzer comprises:

calculating an initial calculated option group with the component option analyzer based on at least the physical characteristic information of the individual, the initial calculated option group comprising an initial calculated option for each of a plurality of club components of the optimized golf club, the plurality of club components comprising:

a first club component; and a second club component;

receiving from the tracking device data from one or more first golf shots by the individual of a first test club comprising:

the initial calculated option for the first club component; and the initial calculated option for the second club component;

calculating with the component option analyzer whether the initial calculated option for the first club component is, for the individual, an optimal option for the first club component;

if the initial calculated option for the first club component is not the optimal option for the first club component:

outputting with the component option analyzer another option for the first club component until the optimal option of the first club component is determined for the individual;

if the initial calculated option for the first club component is the optimal option for the first club component:

receiving from the tracking device data from one or more second golf shots by the individual of a second test club comprising:

the optimal option for the first club component; and the initial calculated option for the second club component;

after determining the optimal option for the first club component:

calculating with the component option analyzer whether the initial calculated option for the second club component is, for the individual, an optimal option for the second club component in view of the optimal option for the first club component;

and if the initial calculated option for the second club component is not the optimal option for the second club component:

outputting with the component option analyzer another option for the second club component until the optimal option of the second club component is determined for the individual;

and the initial calculated option group is calculated, by the component option analyzer:

prior to receiving the data from the one or more first golf shots by the individual of the first test club; and irrespective of any existing club component of any golf club of the individual.

2. A method as defined in claim 1, wherein:

receiving the physical characteristic information associated with the individual comprises:

receiving information associated with at least one of gender, age, dominant hand, hand dimension, height, or wrist-to-floor distance of the individual.

3. A method as defined in claim 1, wherein:

receiving the performance characteristic information associated with the individual comprises:

receiving information associated with at least one of:

an average carry distance of one or more golf clubs, a golf handicap, or a golf preference associated with distance, direction, trajectory, or shot pattern of the individual.

4. A method as defined in claim 1, wherein:

receiving the shot characteristic information associated with the individual comprises:

receiving information associated with at least one of:

speed of a golf club during a shot, speed of a golf ball in response to impact with the golf club, launch angle of the golf ball in response to impact with the golf club, back spin of the golf ball in response to impact with the golf club, side spin of the golf ball in response to impact with the golf club, smash factor of the golf ball, total distance of the shot, bend of the shot, or off-center distance of the shot by the individual.

5. A method as defined in claim 1, further comprising:

generating one or more displays based on at least one of the physical characteristic information, the performance characteristic information, or the shot characteristic information, the one or more displays comprising at least one of a three-dimensional trajectory display, or a shot dispersion display.

6. A method as defined in claim 5, wherein:

at least a portion of the one or more displays are based on at least one of a golf ball condition, a weather condition, or a golf course condition.

7. A method as defined in claim 5, wherein:

generating the one or more displays comprises:

generating the three-dimensional trajectory display with one or more trajectories, each of the one or more trajectories being indicative of an average of a number of golf club shots.

8. A method as defined in claim 5, wherein:

generating the one or more displays comprises:

generating the three-dimensional trajectory display including:

a first trajectory calculated by the trajectory analyzer and displayed in at least one of a first color or a first shading pattern; and a second trajectory calculated by the trajectory analyzer and displayed in at least one of a second color or a second shading pattern.

9. A method as defined in claim 5, wherein:

generating the one or more displays comprises:

generating the three-dimensional trajectory display including:

a first trajectory indicative of a first shot with a golf club; and a second trajectory indicative of a second shot with the golf club.

10. A method as defined in claim 5, wherein:

generating the one or more displays comprises:

generating the three-dimensional trajectory display including:

a first trajectory calculated by the trajectory analyzer and displayed in a first color; and a second trajectory calculated by the trajectory analyzer and displayed in a second color, the first trajectory being indicative of an average of a number of shots associated with a first golf club, and the second trajectory being indicative of an average of a number of shots associated with a second golf club.

11. A method as defined in claim 5, wherein:

generating the one or more displays comprises:

generating the shot dispersion display including two or more perimeters, each of the two or more perimeters being indicative of two or more shots.

12. A method as defined in claim 11, wherein each of the one or more perimeters encompasses a percentage range of golf shots within an area;

a first one of the one or more perimeters circumscribes one of:

hook shots, first draw shots, or pull shots; and a second one of the one or more perimeters circumscribes one of:

second draw shots, slice shots, fade shots, or push shots.

13. A method as defined in claim 12, wherein the first one of the one or more perimeters is correlated to shots from a first golf club comprising a first set of options for the plurality of club components; and the second one of the one or more perimeters is correlated to shots from a second golf club comprising a second set of options for the plurality of club components.

14. A method as defined in claim 1, further comprising:

generating a two-dimensional display including an optimal trajectory range that the individual should target, calculated by the processing device based on one or more swing parameters of the individual;

the optimal trajectory range comprising an upper trajectory bound and a lower trajectory bound delimiting the optimal trajectory range therebetween.

15. A method as defined in claim 14 further comprising:

presenting with the processing device one or more measured golf shot trajectories at the two-dimensional display along with the optimal trajectory range.

16. A method as defined in claim 1, further comprising:
generating with the component option analyzer a component option display at a display device coupled to the processing device;
the component option display presenting the optimized club components for the optimized golf club for the individual, including:
the optimal option for the first club component; and
the optimal option for the second club component.

17. A method as defined in claim 1 further comprising:
identifying an optimal option for a third club component of the plurality of club components in view of the optimal option for the second club component and the optimal option for the first club component; and
identifying an optimal option for a fourth club component of the plurality of club components in view of the optimal option for the third club component, the optimal option for the second club component, and the optimal option for the first club component.

18. A method as defined in claim 1, wherein:
the first club component comprises one of:
a golf club model, a golf club loft angle, a golf club lie angle, a golf club shaft, a golf club length, a golf club grip, a golf club bounce, or a golf club weight;
and
the second club component comprises a different one of:
the golf club model, the golf club loft angle, the golf club lie angle, the golf club shaft, the golf club length, the golf club grip, the golf club bounce, or the golf club weight.

19. A method as defined in claim 1, wherein:
the first club component comprises a golf club model; and
the second club component comprises a golf club loft angle based on the golf club model.

20. A method as defined in claim 1, further comprising:
accessing with the component option analyzer the initial and optimized options for each of the plurality of club components from a database coupled to the processing device.

21. A method as defined in claim 1, wherein:
receiving the shot characteristic information associated with the individual comprises:
receiving data related to one or more actual fitting shots with a first golf ball type at an analyzer module comprising at least one of:
the trajectory analyzer of the processing device; or
a shot dispersion analyzer of the processing device;
and further comprising:
calculating, with the analyzer module, virtual fitting shot trajectory information for one or more virtual fitting shots of a second golf ball type,
the virtual fitting shot trajectory information derived from:
the data related to the one or more actual fitting shots with the first golf ball type; and
golf ball characteristic data associated with the second golf ball type;
and
providing, via the analyzer module, one or more virtual representations of the one or more virtual fitting shots as though the one or more virtual fitting shots had been made with the second golf ball type,
the one or more virtual fitting shots of the second golf ball type having never been swung by the individual.

22. A method as defined in claim 21, wherein:
the first golf ball type comprises at least one of:
a non-premium golf ball type; or
a driving range golf ball type;
and
the second golf ball type comprises at least one of:
a premium golf ball type; or
a non-driving-range golf ball type.

23. A method as defined in claim 1, wherein:
receiving the shot characteristic information associated with the individual comprises:
receiving, at an analyzer module of the processing device, data related to one or more actual fitting shots made at a golf fitting environment by the individual; and
receiving golf target environment characteristic information of a golf target environment;
and further comprising:
calculating, with the analyzer module, virtual fitting shot trajectory information for one or more virtual fitting shots for the golf target environment;
the golf target environment is different than the golf fitting environment;
the virtual fitting shot trajectory information is calculated by the analyzer module from:
the data related to the one or more actual fitting shots made at the golf fitting environment; and
the golf target environment characteristic information;
and
the one or more virtual fitting shots having never been actually swung at the golf target environment by the individual.

24. A method as defined in claim 23 further comprising:
providing, via the analyzer module, one or more virtual representations of the one or more virtual fitting shots as though the one or more virtual fitting shots had been made by the individual at the target golf environment rather than at the golf fitting environment;
wherein the golf target environment characteristic information comprises at least one of:
one or more target weather conditions for the golf target environment;
one or more target golf course conditions for the golf target environment; or
a target golf course altitude for the golf target environment.

25. A method as defined in claim 24, wherein:
the golf target environment characteristic information further comprises:
golf ball characteristic data of a golf ball for the one or more virtual fitting shots of the target golf environment.

26. An apparatus comprising:
a processing device configured to:
receive physical characteristic information, performance characteristic information, and shot characteristic information associated with an individual; and
calculate optimized club components for an optimized golf club for the individual;
the processing device comprising:
a component option analyzer; and
a trajectory analyzer;
wherein:
the trajectory analyzer is configured to receive the shot characteristic information from a tracking device configured to be coupled to the processing device;

the component option analyzer is configured to:

calculate an initial calculated option group based on at least the physical characteristic information of the individual, the initial calculated option group comprising an initial calculated option for each of a plurality of club components of the optimized golf club, the plurality of club components comprising:

a first club component; and a second club component;

receive from the tracking device data from one or more first golf shots by the individual of a first test club comprising:

the initial calculated option for the first club component; and the initial calculated option for the second club component;

calculate whether the initial calculated option for the first club component is, for the individual, an optimal option for the first club component;

if the initial calculated option for the first club component is not the optimal option for the first club component:

output another option for the first club component until the optimal option of the first club component is determined for the individual;

if the initial calculated option for the first club component is the optimal option for the first club component:

receive from the tracking device data from one or more second golf shots by the individual of a second test club comprising:

the optimal option for the first club component; and the initial calculated option for the second club component;

after determining the optimal option for the first club component:

calculate whether the initial calculated option for the second club component is, for the individual, an optimal option for the second club component in view of the optimal option for the first club component;

and if the initial calculated option for the second club component is not the optimal option for the second club component:

output another option for the second club component until the optimal option of the second club component is determined for the individual and the initial calculated option group is calculated, by the component option analyzer:

prior to receiving the data from the one or more first golf shots by the individual of the first test club; and irrespective of any existing club component of any golf club of the individual.

27. An apparatus as defined in claim 26, wherein:

the trajectory analyzer is configured to generate a three-dimensional display with one or more trajectories, each of the one or more trajectories being indicative of an average of a number of golf club shots.

28. An apparatus as defined in claim 26, wherein:

the trajectory analyzer is configured to generate a three-dimensional trajectory display including:

a first trajectory calculated by the trajectory analyzer and displayed in at least one of a first color or a first shading pattern; and a second trajectory calculated by the trajectory analyzer and displayed in at least one of a second color or a second shading pattern.

29. An apparatus as defined in claim 26, wherein:

the trajectory analyzer is configured to generate a two-dimensional display including an optimal trajectory range that the individual should target, calculated by the processing device based on one or more swing parameters of the individual;

the optimal trajectory range comprising an upper trajectory bound and a lower trajectory bound delimiting the optimal trajectory range therebetween.

30. An apparatus as defined in claim 29, wherein:

the trajectory analyzer is configured to present one or more measured golf shot trajectories at the two-dimensional display along with the optimal trajectory range.

31. An apparatus as defined in claim 26, wherein:

the trajectory analyzer is configured to generate a three-dimensional trajectory display based on environment characteristic information, and the environment characteristic information comprises at least one of a golf ball condition, a weather condition, or a golf course condition.

32. An apparatus as defined in claim 26, wherein:

the processing device comprises a shot dispersion analyzer configured to generate a shot dispersion display including one or more perimeters, each of the one or more perimeters being indicative of two or more shots taken with a golf club.

33. An apparatus as defined in claim 32, wherein:

each of the one or more perimeters encompasses a percentage range of golf shots within an area;

a first one of the one or more perimeters circumscribes one of:

hook shots, first draw shots, or pull shots; and a second one of the one or more perimeters circumscribes one of:

second draw shots, slice shots, fade shots, or push shots.

34. An apparatus as defined in claim 33, wherein:

the first one of the one or more perimeters is correlated to shots from a first golf club comprising a first set of options for the plurality of club components; and the second one of the one or more perimeters is correlated to shots from a second golf club comprising a second set of options for the plurality of club components.

35. An apparatus as defined in claim 26, wherein:

the processing device comprises a shot dispersion analyzer configured to generate a shot dispersion display based on environment characteristic information, the environment characteristic information comprises at least one of a golf ball condition, a weather condition, or a golf course condition.

36. An apparatus as defined in claim 26, wherein:

the component option analyzer is configured to generate a component option display presenting the optimized club components for the optimized golf club for the individual, including:

the optimal option for the first club component; and the optimal option for the second club component;

the first club component of the plurality of club components comprises one of:

a golf club model, a golf club loft angle, a golf club lie angle, a golf club shaft, a golf club length, a golf club grip, a golf club bounce, or a golf club weight;

and the second club component of the plurality of club components comprises a different one of:

the golf club model, the golf club loft angle, the golf club lie angle, the golf club shaft, the golf club length, the golf club grip, the golf club bounce, or the golf club weight.

37. An apparatus as defined in claim 26, wherein:

the first club component comprises a golf club model; and the second club component comprises a golf club loft angle based on the golf club model.

38. An apparatus as defined in claim 26, wherein:

the component option analyzer is configured to access the initial and optimized options for each of the plurality of club components from a database coupled to the processing device.

39. An apparatus as defined in claim 26, wherein:

the processing device further comprises an analyzer module comprising at least one of the trajectory analyzer or a shot dispersion analyzer, and is configured to:

receive, from the shot characteristic information associated with the individual, data related to one or more actual fitting shots with a first golf ball type;

calculate virtual fitting shot trajectory information for one or more virtual fitting shots of a second golf ball type, the virtual fitting shot trajectory information derived from:

the data related to the one or more actual fitting shots with the first golf ball type; and golf ball characteristic data associated with the second golf ball type;

and provide one or more virtual representations of the one or more virtual fitting shots as though the one or more virtual fitting shots had been made with the second golf ball type, the one or more virtual fitting shots of the second golf ball type having never been swung by the individual.

40. An apparatus as defined in claim 39, wherein:

the first golf ball type comprises at least one of:

a non-premium golf ball type; or a driving range golf ball type;

and the second golf ball type comprises at least one of:

a premium golf ball type; or a non-driving-range golf ball brand type.

41. An apparatus as defined in claim 26, wherein:

the processing device further comprises an analyzer module configured to:

receive, from the shot characteristic information associated with the individual, data related to one or more actual fitting shots made at a golf fitting environment by the individual;

receive golf target environment characteristic information of a golf target environment different than the golf fitting environment; and calculate virtual fitting shot trajectory information for one or more virtual fitting shots for the golf target environment;

the virtual fitting shot trajectory information derived from:

the data related to the one or more actual fitting shots made at the golf fitting environment; and the golf target environment characteristic information;

and the one or more virtual fitting shots having never been actually swung in the golf target environment by the individual.

42. An apparatus as defined in claim 41, wherein:

the processing device is further configured to:

provide one or more virtual representations of the one or more virtual fitting shots as though the one or more virtual fitting shots had been made at the target golf environment by the individual;

and the golf target environment characteristic information received by the analyzer module comprises at least one of:

one or more target weather conditions;

one or more target golf course conditions; or a target golf course altitude.

43. An apparatus as defined in claim 42, wherein:

the golf target environment characteristic information further comprises:

golf ball characteristic data of a golf ball for the one or more virtual fitting shots of the target golf environment.

44. An article of manufacture including content, which when accessed, causes a machine to:

receive, at a processing device of the machine, physical characteristic information, performance characteristic information, and shot characteristic information associated with an individual; and calculate with the processing device optimized club components for an optimized golf club for the individual;

wherein:

the shot characteristic information is received at a trajectory analyzer of the processing device from a tracking device configured to be coupled to the processing device;

the optimized club components are calculated by a component option analyzer of the processing device;

the article of manufacture comprises the trajectory analyzer and the component option analyzer;

the component option analyzer is configured to:

calculate an initial calculated option group based on at least the physical characteristic information of the individual, the initial calculated option group comprising an initial calculated option for each of a plurality of club components of the optimized golf club, the plurality of club components comprising:

a first club component; and a second club component;

receive from the tracking device data from one or more first golf shots by the individual of a first test club comprising:

the initial calculated option for the first club component; and the initial calculated option for the second club component;

calculate whether the initial calculated option for the first club component is, for the individual, an optimal option for the first club component;

if the initial calculated option for the first club component is not the optimal option for the first club component:

output another option for the first club component until the optimal option of the first club component is determined for the individual;

if the initial calculated option for the first club component is the optimal option for the first club component:

receive from the tracking device data from one or more second golf shots by the individual of a second test club comprising:

the optimal option for the first club component; and the initial calculated option for the second club component;

after determining the optimal option for the first club component:

calculate whether the initial calculated option for the second club component is, for the individual, an optimal option for the second club component in view of the optimal option for the first club component;

and if the initial calculated option for the second club component is not the optimal option for the second club component:

output another option for the second club component until the optimal option of the second club component is determined for the individual;

and the initial calculated option group is calculated, by the component option analyzer:

prior to receiving the data from the one or more first golf shots by the individual of the first test club; and irrespective of any existing club component of any golf club of the individual.

45. An article of manufacture as defined in claim 44, wherein:

the physical characteristic information comprises at least one of gender, age, dominant hand, hand dimension, height, or wrist-to-floor distance of the individual.

46. An article of manufacture as defined in claim 44, wherein:

the performance characteristic information comprises at least one of:

an average carry distance of one or more golf clubs, a golf handicap, or a golf preference associated with distance, direction, trajectory, or shot pattern of the individual.

47. An article of manufacture as defined in claim 44, wherein:

the shot characteristic information comprises at least one of:

speed of a golf club during a shot, speed of a golf ball in response to impact with the golf club, launch angle of the golf ball in response to impact with the golf club, back spin of the golf ball in response to impact with the golf club, side spin of the golf ball in response to impact with the golf club, smash factor of the golf ball, total distance of the shot, bend of the shot, or off-center distance of the shot by the individual.

48. An article of manufacture as defined in claim 44, wherein:

the content, when accessed, causes the machine to generate one or more displays based on at least one of the physical characteristic information, the performance characteristic information, or the shot characteristic information, the one or more displays comprising at least one of a three-dimensional trajectory display, or a shot dispersion display.

49. An article of manufacture as defined in claim 48, wherein:

at least a portion of the one or more displays are based on at least one of a golf ball condition, a weather condition, or a golf course condition.

50. An article of manufacture as defined in claim 48, wherein:

the content, when accessed, causes the machine to generate the three-dimensional trajectory display with one or more trajectories, each of the one or more trajectories being indicative of an average of a number of golf club shots.

51. An article of manufacture as defined in claim 48, wherein:

the content, when accessed, causes the machine to generate the three-dimensional trajectory display including:

a first trajectory calculated by the trajectory analyzer and displayed in at least one of a first color or a first shading pattern; and a second trajectory calculated by the trajectory analyzer and displayed in at least one of a second color or a second shading pattern.

52. An article of manufacture as defined in claim 48, wherein:

the content, when accessed, causes the machine to generate the shot dispersion display including two or more perimeters, each of the two or more perimeters being indicative of two or more shots.

53. An article of manufacture as defined in claim 44, wherein:

the content, when accessed, causes the machine to generate a two-dimensional display including an optimal trajectory range that the individual should target based on one or more swing parameters of the individual;

the optimal trajectory range comprising an upper trajectory bound and a lower trajectory bound delimiting the optimal trajectory range therebetween.

54. An article of manufacture as defined in claim 53, wherein:

the content, when accessed, causes the machine to present via the processing device one or more measured golf shot trajectories at the two-dimensional display along with the optimal trajectory range.

55. An article of manufacture as defined in claim 44, wherein:

the content, when accessed, causes the machine to generate a component option display at a display device coupled to the processing device;

the component option display presenting the optimized club components for the optimized golf club for the individual, including:

the optimal option for the first club component; and the optimal option for the second club component.

56. A system comprising:

a tracking device to measure golf shot data of an individual; and a processing device operatively coupled to the tracking device to:

receive physical characteristic information, performance characteristic information, and shot characteristic information associated with the individual; and calculate optimized club components for an optimized golf club for the individual;

wherein:

the shot characteristic information is received, from the tracking device, at a trajectory analyzer of the processing device;

the optimized club components are calculated by a component option analyzer of the processing device;

the component option analyzer is configured to:

calculate an initial calculated option group based on at least the physical characteristic information of the individual, the initial calculated option group comprising an initial calculated option for each of a plurality of club components of the optimized golf club, the plurality of club components comprising:

a first club component; and a second club component;

receive from the tracking device data from one or more first golf shots by the individual of a first test club comprising:

the initial calculated option for the first club component; and the initial calculated option for the second club component;

calculate whether the initial calculated option for the first club component is, for the individual, an optimal option for the first club component;

if the initial calculated option for the first club component is not the optimal option for the first club component:

output another option for the first club component until the optimal option of the first club component is determined for the individual;

if the initial calculated option for the first club component is the optimal option for the first club component:

receive from the tracking device data from one or more second golf shots by the individual of a second test club comprising:

the optimal option for the first club component; and the initial calculated option for the second club component;

after determining the optimal option for the first club component:

calculate whether the initial calculated option for the second club component is, for the individual, an optimal option for the second club component in view of the optimal option for the first club component;

and if the initial calculated option for the second club component is not the optimal option for the second club component:

output another option for the second club component until the optimal option of the second club component is determined for the individual;

and the initial calculated option group is calculated, by the component option analyzer:

prior to receiving the data from the one or more first golf shots by the individual of the first test club; and irrespective of any existing club component of any golf club of the individual.

57. A system as defined in claim 56, wherein:

the physical characteristic information comprises at least one of gender, age, dominant hand, hand dimension, height, or wrist-to-floor distance of the individual.

58. A system as defined in claim 56, wherein:

the performance characteristic information comprises at least one of an average carry distance of one or more golf clubs, a golf handicap, or a golf preference associated with distance, direction, trajectory, or shot pattern of the individual.

59. A system as defined in claim 56, wherein:

the shot characteristic information comprises at least one of speed of a golf club during a shot, speed of a golf ball in response to impact with the golf club, launch angle of the golf ball in response to impact with the golf club, back spin of the golf ball in response to impact with the golf club, side spin of the golf ball in response to impact with the golf club, smash factor of the golf ball, total distance of the shot, bend of the shot, or off-center distance of the shot by the individual.

60. A system as defined in claim 56, wherein:

the processing device is configured to generate one or more displays based on at least one of the physical characteristic information, the performance characteristic information, or the shot characteristic information, the one or more displays comprising at least one of a three-dimensional trajectory display, or a shot dispersion display.

61. A system as defined in claim 60, wherein:

at least a portion of the one or more displays are based on at least one of a golf ball condition, a weather condition, or a golf course condition.

62. A system as defined in claim 60, wherein:

the processing device is configured to generate the three-dimensional trajectory display with one or more trajectories, each of the one or more trajectories being indicative of an average of a number of golf club shots.

63. A system as defined in claim 60, wherein:

the processing device is configured to generate the three-dimensional trajectory display including:

a first trajectory calculated by the trajectory analyzer and displayed in at least one of a first color or a first shading pattern; and a second trajectory calculated by the trajectory analyzer and displayed in at least one of a second color or a second shading pattern.

64. A system as defined in claim 60, wherein:

the processing device is configured to generate the shot dispersion display including two or more perimeters, each of the two or more perimeters being indicative of two or more golf shots.

65. A system as defined in claim 56, wherein:

the processing device is configured to generate a two-dimensional display including an optimal trajectory range that the individual should target based on one or more swing parameters of the individual;

the optimal trajectory range comprising an upper trajectory bound and a lower trajectory bound delimiting the optimal trajectory range therebetween.

66. A system as defined in claim 65, wherein:

the processing device is configured to present one or more measured golf shot trajectories at the two-dimensional display along with the optimal trajectory range.

67. A system as defined in claim 56, wherein:

the processing device is configured to generate a component option display at a display device coupled to the processing device; and the component option display configured to present the optimized club components for the optimized golf club for the individual, including:

the optimal option for the first club component for the individual; and the optimal option for the second club component for the individual.

* * * * *